US007645249B2

(12) United States Patent
Kim et al.

(10) Patent No.: US 7,645,249 B2
(45) Date of Patent: Jan. 12, 2010

(54) FIXING STRUCTURE FOR TREATMENT HEAD AND MEDICAL APPARATUS HAVING THE FIXING STRUCTURE

(75) Inventors: Doo Sang Kim, Seoul (KR); Heung Gu Im, Seoul (KR); Se Yun Kim, Seoul (KR)

(73) Assignee: Happy Medical Co., Ltd., Gyeonggido (KR)

( * ) Notice: Subject to any disclaimer, the term of this patent is extended or adjusted under 35 U.S.C. 154(b) by 0 days.

(21) Appl. No.: 12/015,580

(22) Filed: Jan. 17, 2008

(65) Prior Publication Data

US 2008/0177212 A1 Jul. 24, 2008

(30) Foreign Application Priority Data

Jan. 22, 2007 (KR) ..... 20-2007-0001127 U

(51) Int. Cl.
*A61H 15/00* (2006.01)
*A61H 19/00* (2006.01)
*A61H 23/00* (2006.01)

(52) U.S. Cl. ..... 601/122; 601/84; 601/87; 601/1; 601/97; 601/99; 601/100; 601/102; 601/112; 601/113; 601/118; 601/128

(58) Field of Classification Search ..... 602/33, 602/32, 1; 601/1, 84, 118, 115, 134, 90, 601/93, 148, 86, 102, 100, 103, 99, 122, 601/128

See application file for complete search history.

(56) References Cited

U.S. PATENT DOCUMENTS

2004/0171972 A1 * 9/2004 Shimizu et al. ..... 601/99
2007/0106192 A1 * 5/2007 Johnson ..... 602/32

* cited by examiner

*Primary Examiner*—Patricia M Bianco
*Assistant Examiner*—Tarla R Patel
(74) *Attorney, Agent, or Firm*—Harness, Dickey & Pierce, PLC

(57) ABSTRACT

The present invention relates to a medical apparatus for spinal therapy, which is a bed-type apparatus equipped with a treatment head and performs message and acupressure while moving along the length of the spine, and more particularly to a fixing structure of a treatment head in the medical apparatus, which wears out slowly and allows the treatment head to move in a vertical direction. The medical apparatus for spinal therapy having the fixing structure of a treatment head is advantageous over known apparatuses in that it can give various types of stimulation to human body parts and incurs lower maintenance expenses.

7 Claims, 3 Drawing Sheets

FIXING STRUCTURE FOR TREATMENT HEAD AND MEDICAL APPARATUS HAVING THE FIXING STRUCTURE

FIELD

The present invention relates to a bed-type massaging apparatus or a medical apparatus equipped with a treatment head giving massage and finger-pressure effects, and more particularly to a fixing structure for fixing a treatment head, which allows the treatment head to perform vertical linear motion as well as lateral rotational motion, and a medical apparatus having the fixing structure.

BACKGROUND

"Disk disease" is a term used to describe changes in spinal disks, leading to pain, which are caused when pressure is put on the disk space between adjacent vertebrae in the spine or when spinal fluid leaks out of the disk space due to the deformation of the outer layer (annulus or capsule) of the disk.

Changes to the spinal disks are generally caused in a manner such that the disks project from the back surface of the spine, putting pressure on the anterior spinal nerve root. This causes a patient to suffer from neuralgia, resulting in deformation of the posture of the patient when the pain is acute. In cases in which disk disease is slight, the pain can be alleviated by taking a rest or wearing a corset. However, in cases of advanced disk disease, the projecting cartilage must be surgically removed. Such disk disease may occur in the cervical vertebral.

The most widely known therapy for treating disk disease is to expand the narrowed disk space between the vertebrae through various therapies and to reinforce the muscles around the disks so that the spinal fluid returns to its original position.

However, such therapy is generally performed using expensive medical apparatuses. Accordingly, it is inconvenient for general patients to receive spinal therapy because the patients must visit clinics equipped with the medical apparatuses and the therapy is expensive.

Due to the disadvantages of the known medical apparatuses, various modified medical apparatuses that can allow patients to receive spinal therapy in their homes have been suggested. Among such medical apparatuses, bed-type medical apparatuses are popular.

Such a bed-type medical apparatus for spinal therapy generally has a treatment head which is supplied with driving force from a motor. The treatment head performs spinal therapy by reciprocating while putting a predetermined pressure on the spine of a patient. Some treatment heads are equipped with lamps, such as helium lamps, infrared lamps, or high frequency lamps, which have a heating or warming function, so that the treatment heads perform the spinal therapy via the acupressure function and the heating and warming function.

Korean Patent Application No. 2002-23915 discloses a medical apparatus for spinal therapy, which includes a rocking means which performs a lateral (left and right) rocking motion around the spine while it rectilinearly moves along the length of the spine. The rocking means comprises a pair of wave rails separately disposed on both sides of a guide groove in the widthwise direction of the guide groove. The wave rails are repeatedly curved up and down in opposite directions and guide the treatment head, which is in contact with the upper surfaces thereof, so that it sways left and right.

With reference to FIG. 1, which shows a general medical apparatus for spinal therapy, including the above-mentioned apparatus disclosed in the patent application, the medical apparatus for spinal therapy includes a sponge-like mattress 10 having elasticity, which serves as a bed, on which a patient can lie, and serves as a base on which a treatment head 20 and various components for moving the treatment head 20 are mounted.

The mattress 10 is provided with a guide groove 15 that has a predetermined width and depth so as to guide the treatment head 20 to move in the longitudinal direction of the spine of a patient. A pair of flat rails 16 having a simple straight line form is disposed on the bottom of the guide groove 15 and are separated from each other in the widthwise direction of the guide groove 15 by a predetermined distance in order to enable the treatment head 20 to move smoothly.

The treatment head 20 is a device that performs spinal therapy by reciprocating along the guide groove 15, and thus the treatment head 20 performs the acupressure function against the spine and the muscles around the spine of the patient. The treatment head 20 is provided with a plurality of acupressure protrusions 22, in which lamps are embedded for performing a heating or warming function, and a pair of wheels 26 and 27, which are disposed on the lower surfaces thereof and are in contact with the flat rails 16 in a rolling manner.

The treatment head 20 receives driving force from a driving device installed inside the mattress 10 and thus reciprocates along a predetermined path defined by the guide groove 15.

The driving device includes a reversible motor 35 for generating driving force, wheels 30 and 31, and a transmitting wire 32 for transmitting the driving force to the treatment head 20. The reversible motor 35 receives electric power from an external power source and generates rotating force in a forward direction or a backward direction. It is known from the illustration of FIG. 1 that the reversible motor 35 is installed inside the mattress 10.

Although it is not shown in the figure, the reversible motor 35 is wired so as to generate the rotating force selectively in the forward direction or the backward direction in response to a signal from a switch (not shown) manipulated by a user, and is also configured so as to generate the rotating force in the forward direction or the backward direction selectively in response to a signal from a limit switch (not shown) installed at both ends of the guide groove 15.

The rotating force of the reversible motor 35 can be transmitted in a manner such that the output end of the reversible motor 35 is connected to a drive wheel 30 of the pair of wheels installed at both ends of the guide groove 15. As shown in FIG. 1, the drive wheel 30 is installed at one end of the guide groove 15 and a driven wheel 31 is installed in a freely rotatable manner at the other end of the guide groove 15, which is opposite the end at which the drive wheel 30 is installed. The drive wheel 30 and the driven wheel 31 are connected by the transmitting wire 32.

The transmitting wire 32 is a component that is connected with the front and the back surfaces of the treatment head 20 in the advancing direction of the treatment head 20 at both ends thereof, and thus transmits the driving force of the reversible motor 35 to the treatment head 20. The transmitting wire 32 can take various forms according to the shape of the drive wheel 30 and the driven wheel 31. For example, if the drive wheel 30 and the driven wheel 31 are configured as sprockets, the transmitting wire may be a chain. In the case in which the drive wheel 30 and the driven wheel 31 are rollers, the transmitting wire 32 may be a belt.

However, the known medical apparatuses for spinal therapy, including the apparatus disclosed in the above-mentioned patent application, have a problem in that the treatment head 20 is fitted in a manner such that a center portion thereof is mounted by a hinge member 24, so that the treatment head 20 can pivot to left side and the right side of a main body 25 in the widthwise direction of the guide groove 15, as shown in FIG. 2, which is a sectional view illustrating the fixing structure of the treatment head. However, the hinge member 24 is subjected to a strong frictional force when the treatment head 20 undergoes left and right rotational motion. Accordingly, the hinge member 24 may be easily worn out, resulting in operational failure of the medical apparatus. Further, in the case in which the medical apparatus has the above-described structure, it is impossible to replace only a worn component; instead, the entire treatment head must be replaced.

Further, the above-mentioned fixing structure of the treatment head has a disadvantage in that it can allow the treatment head to pivot to the left side and the right side with respect to the hinged portion, but cannot allow the treatment head to perform vertical linear motion. Accordingly, the medical apparatus employing the fixing structure cannot give various types of stimulation to human body parts.

Accordingly, it is necessary to develop an innovative fixing structure of a treatment head which can solve the above-mentioned problems.

SUMMARY OF THE INVENTION

In order to solve the above-mentioned problems, the inventors of this application have conducted research for a long period of time and performed a number of repeated experiments, and have thus reached an outcome in the form of an innovative fixing structure of a treatment head using a ball bearing structure.

One advantage of the invention is to provide a fixing structure of a treatment head which wears out slowly even if strong frictional force is applied to the fixing structure due to the lateral rotational motion of the treatment head, so that it is possible to greatly extend the replacement period of the treatment head.

Another advantage of the invention is to provide a fixing structure of a treatment head which permits only a worn component of the treatment head to be replaced with a new one, rather than requiring replacement of the entire body of the treatment head.

A further advantage of the invention is to provide a fixing structure which allows vertical linear motion of the fixing head as well as lateral rotational motion thereof.

A still further advantage of the invention is to provide a medical apparatus for spinal therapy having the above-mentioned fixing structure, which is thereby capable of giving various types of stimulation to human body parts and incurs lower maintenance expenses.

According to one aspect of the invention, there is provided a fixing structure of a treatment head including a main body equipped with wheels in contact with a rail installed on a guide groove in a rolling manner, and a head equipped with a plurality of acupressure protrusions which are installed on an upper portion of the main body so as to be separated from each other in order to apply predetermined pressure to the spine, the fixing structure including a pair of fixing units provided to both ends of the head for fixing the head to the main body so that the height thereof is smaller than the distance between the head and the main body.

In the fixing structure, it is preferable that each of the fixing units have a ball bearing structure including a ball bearing, a ball bearing member which is disposed at the end of the head so that it is perpendicular to the upper portion of the main body, and in which part of the ball bearing is inserted, and a cover member fixed to the upper portion of the main body and provided with a trench-type groove extending in a vertical direction so that the other part of the ball bearing is inserted in the trench-type groove and moves in the vertical direction.

In the fixing structure, it is preferable that a plurality of elastic supports be provided between a lower portion of the head and the upper portion of the main body.

In the fixing structure, it is preferable that the ball bearing be made of a material having high strength and durability, which is selected from a group consisting of ceramic, engineering plastic, fiberglass, metal, and magnet.

In the fixing structure, it is preferable that the material forming the trench-type groove of the cover portion have high strength and durability, and that it be selected from the group consisting of ceramic, engineering plastic, fiberglass, metal, and magnet.

According to another aspect of the invention, there is provided a medical apparatus for spinal therapy which is provided with the fixing structure according to the invention.

In the medical apparatus, it is preferable that laser diodes be provided on the upper portion of the head, particularly in the acupressure protrusions.

BRIEF DESCRIPTION OF THE DRAWINGS

The above and other features and advantages of the present invention will be more clearly understood from the following detailed description when taken in conjunction with the accompanying drawings, in which.

DETAILED DESCRIPTION OF THE INVENTION

Hereinafter, a preferred embodiment of the invention will be described in detail with reference to the accompanying drawings.

The invention will be described in detail below with reference to the accompanying drawings.

Figure 1:
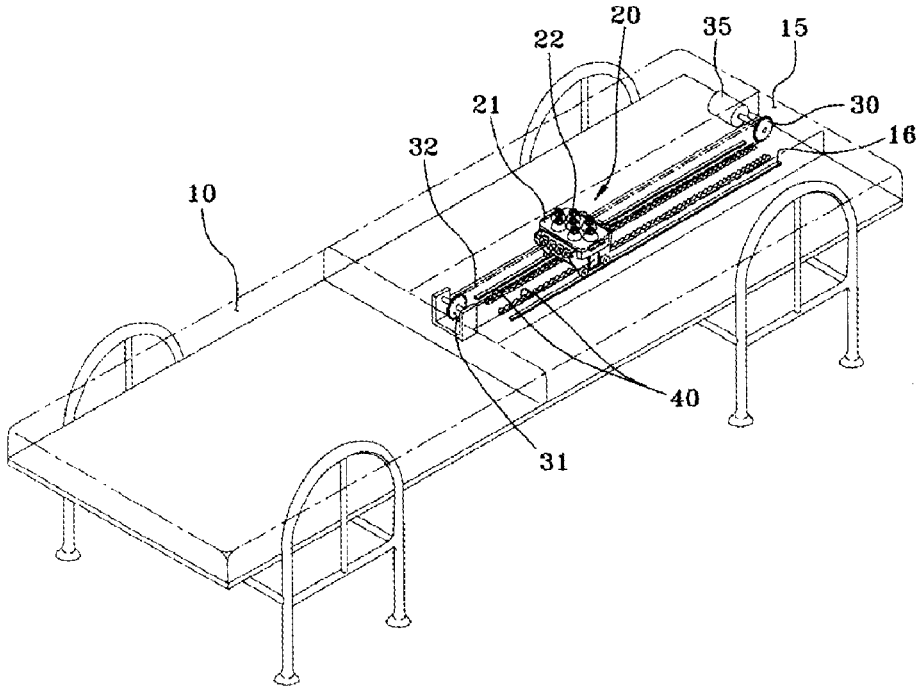
FIG. 1 is a perspective view illustrating a known medical apparatus for spinal therapy.
Figure 2:
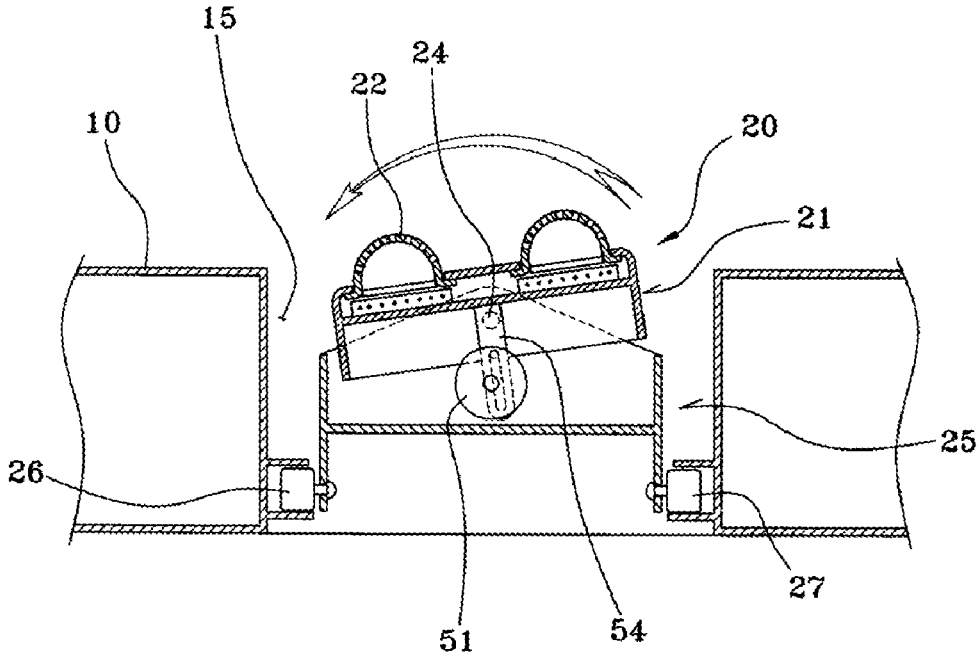
FIG. 2 is a sectional view illustrating a treatment head of the medical apparatus shown in FIG. 1.
Figure 3:
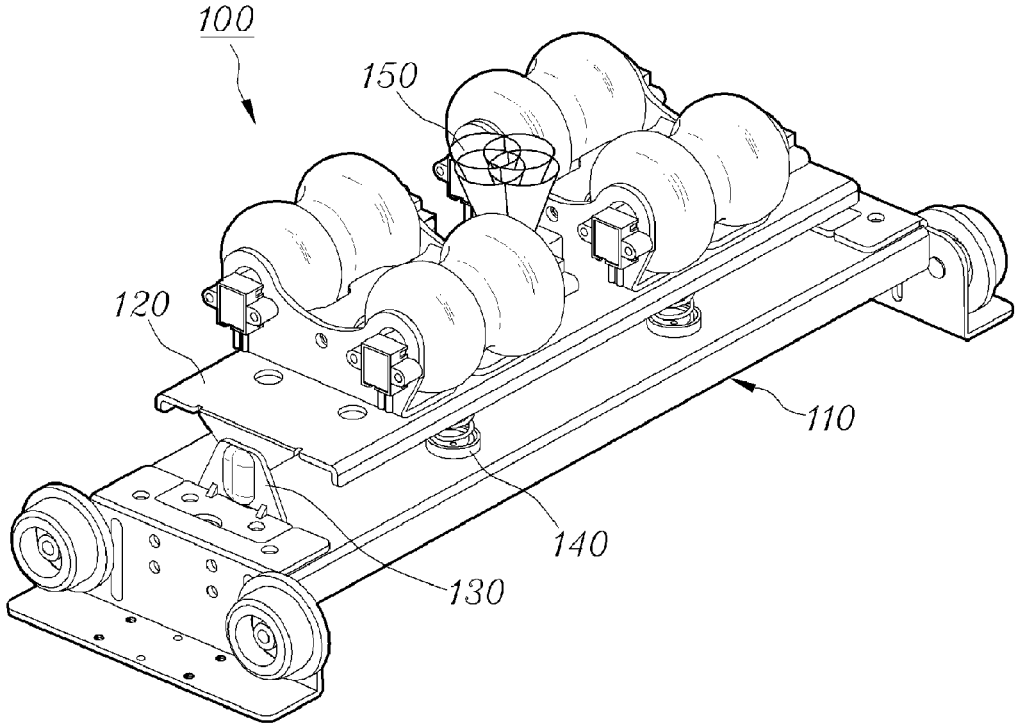
FIG. 3 is a perspective view illustrating a treatment head of a medical apparatus, which is fitted to a base using a fixing structure according to one embodiment of the invention.
Figure 4:
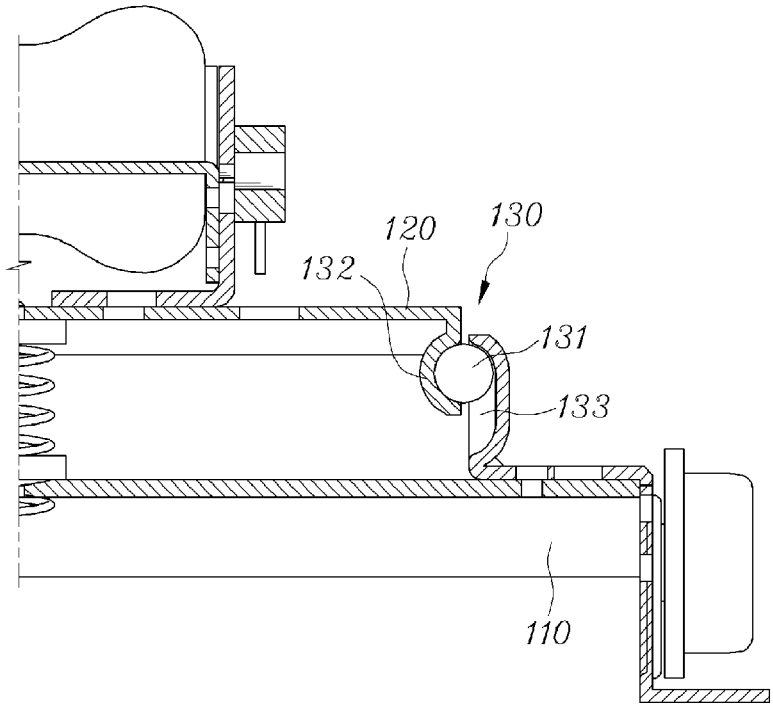
FIG. 4 is a sectional view illustrating the fixing structure shown in FIG. 3.
Figure 5A:
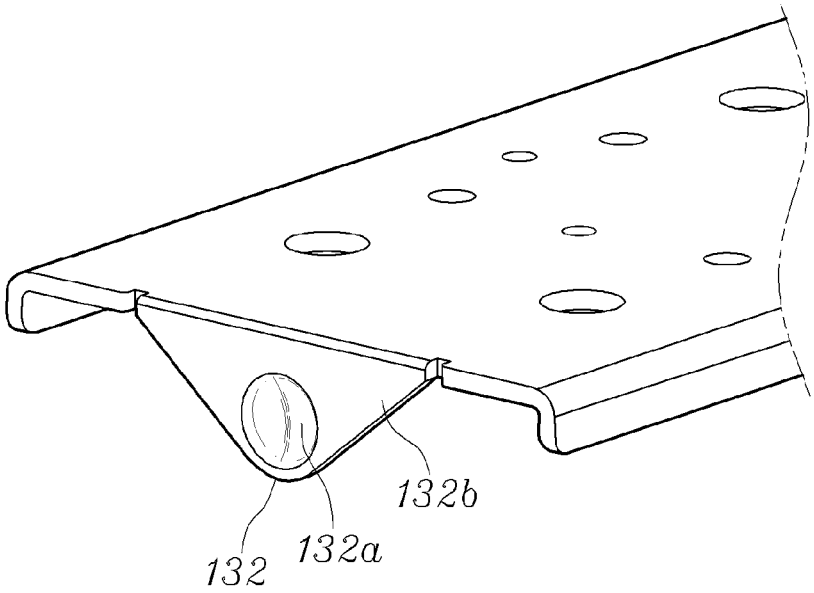
FIG. 5A and FIG. 5B are views illustrating details of a ball bearing member and a cover member of the fixing structure shown in FIG. 3.
Figure 5B:
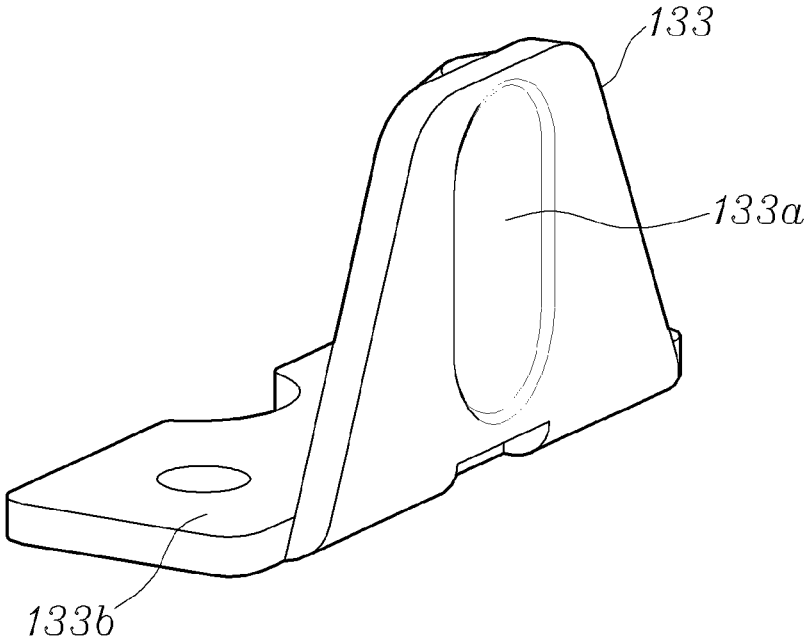

FIG. 3 is a perspective view illustrating a fixing structure of a treatment head according to one embodiment of the invention, FIG. 4 is a sectional view illustrating the fixing structure shown in FIG. 3, and FIGS. 5A and 5B are views illustrating details of a cover member of the fixing structure shown in FIG. 3.

As shown in FIG.3, the fixing structure of a treatment head according to one embodiment of the invention includes a pair of fixing units 130 which are provided at both ends of a head 120 for fixing the head 120, which is equipped with a plurality of acupressure protrusions which apply predetermined pressure to human body parts, to a main body 110, which is provided with wheels that are in contact with a rail installed in a guide groove in a rolling manner. Each of the fixing units 130 is installed above the main body 110 so as to be spaced apart from the upper surface of the main body 110.

The fixing unit 130 serves to fix the head 120 to the main body 110 and has a height less than the distance between the head 120 and the main body 110. A plurality of elastic supports 140 is installed between the head 120 and the main body 110 so that the lower portion of the head 120 is connected to the upper portion of the main body 110.

The plurality of elastic supports 140 is provided to help the fixing units 130 more securely fix the head 120 to the main body 110, and thus they may be resilient members such as springs. The plurality of elastic supports 140 maintains the distance between the head 120 and the main body 110 and thus a ball bearing 131 of each of the fixing units 130 shown in FIG. 4 is disposed on the upper side of the cover member 133.

With reference to FIGS. 4, 5A, and 5B, it can be seen that the fixing unit 130 includes the ball bearing 131, a ball bearing member 132 and the cover member 133.

The ball bearing 131 refers to a sphere shape, and is made of a material that can endure abrasion, for example, ceramic, engineering plastic, fiberglass, metal, and magnet, but the material is not limited thereto. That is, the ball bearing 131 may be made of a material having high strength and durability, such as metal and a magnetic material.

As shown in FIG. 4, the ball bearing member 132 is disposed perpendicular to the upper portion of the main body 110 at the end portion of the head 120. The ball bearing member 132 has a hemispherical space in which part of the ball bearing 131 is received and which is formed so as to project in the direction of the head 120. It is preferable that the ball bearing member 132 and the ball bearing 131 be combined by force such that part of the ball bearing 131, which is less than the half of the ball bearing, is inserted in the ball bearing member 132 but is not separated from the ball bearing member 132. In such a state, the ball bearing 131 rotates in the ball bearing member 132.

For this instance, as shown in FIG. 5A, the ball bearing member 132 includes a hemispherical groove 132*a*, in which part of the ball bearing 131 is inserted, and a plate portion 132*b*. The ball bearing member 132 may be formed integrally with the head 120, but may alternatively be formed detachably from the head 120.

At least the hemispherical groove 132*a*, receiving part of the ball bearing 131, is preferably made of a material having high strength and durability, such as ceramic, engineering plastic, fiberglass, metal, and magnet.

According to the circumstances, the entire body of the ball bearing member 132 may be made of a material having high strength and durability.

Next, as shown in FIG. 5B, the cover member 133 includes a trench-type groove 133*a* in which the other part of the ball bearing 131, which is not inserted into the ball bearing member 132, is inserted, and can move in a vertical direction, and a plate portion 133*b* which is to be fixed to the upper portion of the main body 110.

The trench-type groove 133*a* is concave in the direction facing away from the head 121. The trench-type groove 133*a* has a width such that the ball bearing 131 can be inserted in the trench-type groove 133*a* but not come out of the trench-type groove 133*a* while it can rotate in the trench-type groove 133*a*. The maximum depth of the trench-type groove 133*a* is set such that half of the ball bearing 131 can be inserted, and the length of the trench-type groove 133*a* is set so that it is equal to the distance between the head 120 and the main body 110 and is smaller than the diameter of the ball bearing 131. It is preferable that the length of the trench-type groove 133*a* be at least two times the diameter of the ball bearing 131.

The material of a member forming the trench-type groove 133*a* has high strength and durability, and examples thereof include ceramic, engineering plastic, fiberglass, metal, and magnet. According to the circumstances, the entire body of the cover member 133 may be made of a material having high strength and durability.

If the main body 110 and the head 120 of the treatment head 100 are fixed by the fixing units 130, which are described above, as shown in FIG. 4, the center portion of the head 120 is fixed to the main body 110.

According to such a structure, the treatment head 100 can perform vertical linear motion as well as lateral rotational motion thanks to the ball bearing 131, which moves in the vertical direction along the length of the trench-type groove 133*a* in the ball bearing members 132 at both ends of the head 120. That is, the treatment heads 100 can linearly move in the vertical direction within a range limited by the length of the trench-type groove 133*a*.

At this time, it is preferable that the ball bearing, the ball bearing member, and the cover member be configured in a manner such that an attraction force is exerted between them. For example, any one of them is made of a magnetic material, and the others are made of metal. In such a case, the fixing structure may be more stable.

A medical apparatus for spinal therapy (not shown), including the treatment head 100 fixed by the fixing structure 130, are similar to known medical apparatuses except for the fixing structure. Accordingly, details about parts of the medical apparatus other than the fixing structure will not be described. When electric power is applied to the medical apparatus for spinal therapy according to the invention, the treatment head can perform vertical linear motion as well as lateral rotational motion. Accordingly, the medical apparatus can give various types of stimulation to human body parts, and thus have an increased therapy effect.

With reference to FIG. 4, the ball bearing 131, which is an element of the fixing structure, may be worn due to friction attributable to lateral rotational motion and vertical linear motion, but the rate of wear is very low. Further, even if the ball bearing 131 is worn, the ball bearing 131 is worn uniformly over the entire surface thereof due to the rotational motion. Accordingly, the ball bearing can be used for a long period.

Still further, when the ball 131 is worn out and cannot be used any longer, it is sufficient to replace only the ball bearing 131, instead of replacing the entire treatment head 100. Yet further, even if the ball bearing member 132 or the cover member 133 is worn out after the treatment head 100 is repeatedly used for a lengthy period of time, only the worn components, the ball bearing member 132 or the cover member 133, need be replaced with new ones. Accordingly, the life span of the medical apparatus according to the invention is very long and maintenance cost is remarkably low compared to known medical apparatuses.

Further, according to the embodiment of the invention, the acupressure protrusions of the treatment head are equipped with laser diodes 150 therein, unlike the known medical apparatuses, in which the acupressure protrusions are equipped with lamps having a heating and warming function. Accordingly, the medical apparatus according to the embodiment has a laser treatment effect.

The invention is not limited to the above-described particular embodiments, but it will be apparent to those skilled in the art that various modifications and variations may be made without departing from the spirit or scope of the invention. All such changes, modifications, and variations should be therefore seen as falling within the scope of the invention defined by claims.

As described above, the invention has the following advantages.

Thanks to the innovative fixing structure, even if the fixing structure is subjected to strong friction due to lateral rotational motion, the wear rate is very low and thus the replacement period for the components of the medical apparatus can be prolonged.

Further, even if the fixing structure of the treatment head is worn out, only the worn component need be replaced with a new one, instead of replacing the entire body of the treatment head. Accordingly, it is possible to remarkably decrease the maintenance and labor costs.

Still further, since the treatment head can perform vertical linear motion as well as lateral rotational motion, it is possible to give various types of stimulation to human body parts.

The medical apparatus for spinal therapy equipped with a treatment head which is fixed by the fixing structure according to the invention has a long lifespan, can be easily repaired, incurs a low maintenance cost, and has good therapeutic performance because it employs a structure that can give various types of stimulation to human body parts.

What is claimed is:

1. A fixing structure of a treatment head including a main body equipped with wheels in contact with a rail installed on a guide groove in a rolling manner, and a head equipped with a plurality of acupressure protrusions which are installed on an upper portion of the main body so as to be separated from each other in order to give a predetermined pressure to a spine, the fixing structure comprising:

a pair of fixing units which are provided on respective ends of the head for fixing the head to the main body, each of the fixing units having a height less than a distance between the head and the main body;

wherein each of the pair of fixing units includes:

a ball bearing;

a ball bearing member which is disposed at the end of the head so as to be perpendicular to the upper portion of the main body and in which part of the ball bearing is inserted;

a cover member fixed to the upper portion of the main body and provided with a trench-type groove extending in a vertical direction so that the other part of the ball bearing is inserted in the trench-type groove, the ball bearing moving in the vertical direction; and a plurality of elastic supports provided between a lower portion of the head and the upper portion of the main body.

2. The fixing structure of a treatment head according to claim 1, wherein the ball bearing is made of a material having high strength and durability, which is selected from a group consisting of ceramic, engineering plastic, fiberglass, metal, and magnetic material.

3. The fixing structure of a treatment head according to claim 1, wherein a member surrounding the trench-type groove of the cover member is made of a material having high strength and durability, which is selected from the group consisting of ceramic, engineering plastic, fiberglass, metal, and a magnetic material.

4. The fixing structure of a treatment head according to claim 1, wherein the trench-type groove has a length extending along the vertical direction.

5. The fixing structure of a treatment head according to claim 4, wherein the ball bearing moves in the trench-type groove along the length of the trench-type groove.

6. The fixing structure of a treatment head according to claim 1, wherein the ball bearing has a sphere shape and disposed between the ball bearing member and the cover member, the ball bearing contacting the ball bearing member and the cover member.

7. The fixing structure of a treatment head according to claim 6, wherein the ball bearing member defines a hemispherical groove and the ball bearing is disposed in the hemispherical groove of the ball bearing member and the trench-like groove of the cover member.

* * * * *